United States Patent [19]

Koskimies et al.

[11] 4,116,259

[45] Sep. 26, 1978

[54] DAMPING STRUCTURE IN A PIPE SYSTEM DELIVERING PULP SUSPENSION TO A HEADBOX

[75] Inventors: Jouni Koskimies, Jyvaskyla; Erkki Ilmoniemi, Vaajakoski, both of Finland

[73] Assignee: Valmet Oy, Finland

[21] Appl. No.: 852,983

[22] Filed: Nov. 18, 1977

[30] Foreign Application Priority Data

Nov. 22, 1976 [FI] Finland ..... 763351

[51] Int. Cl.[2] ..... D21F 1/06

[52] U.S. Cl. ..... 162/380; 137/207; 138/26

[58] Field of Search ..... 162/340, 380; 417/543; 137/207; 138/30, 26

[56] References Cited

U.S. PATENT DOCUMENTS 3,447,557 6/1969 Phelps et al. ..... 137/207
3,563,852 2/1971 Rojecki ..... 162/340 X
4,030,971 6/1977 Justus ..... 162/340 X

*Primary Examiner*—Richard V. Fisher
*Attorney, Agent, or Firm*—Steinberg & Blake

[57] ABSTRACT

An approach pipe system which delivers pulp suspension to the headbox of a paper machine includes a tank having in its interior an upper gas space and a lower liquid space adapted to contain a liquid the upper surface of which contacts the gas in the gas space. In its interior this tank carries a flexible diaphragm which defines with the tank a flow space separated from the liquid space by the flexible diaphragm. A supply pipe communicates with this flow space for delivering a pulp suspension thereto while a discharge pipe also communicates with the flow space for receiving a pulp suspension therefrom and for continuing the travel of the pulp suspension to a headbox. The gas in the gas space acts through the liquid in the liquid space on the diaphragm to damp pressure and flow rate disturbances in the pulp suspension flowing toward the headbox.

14 Claims, 4 Drawing Figures

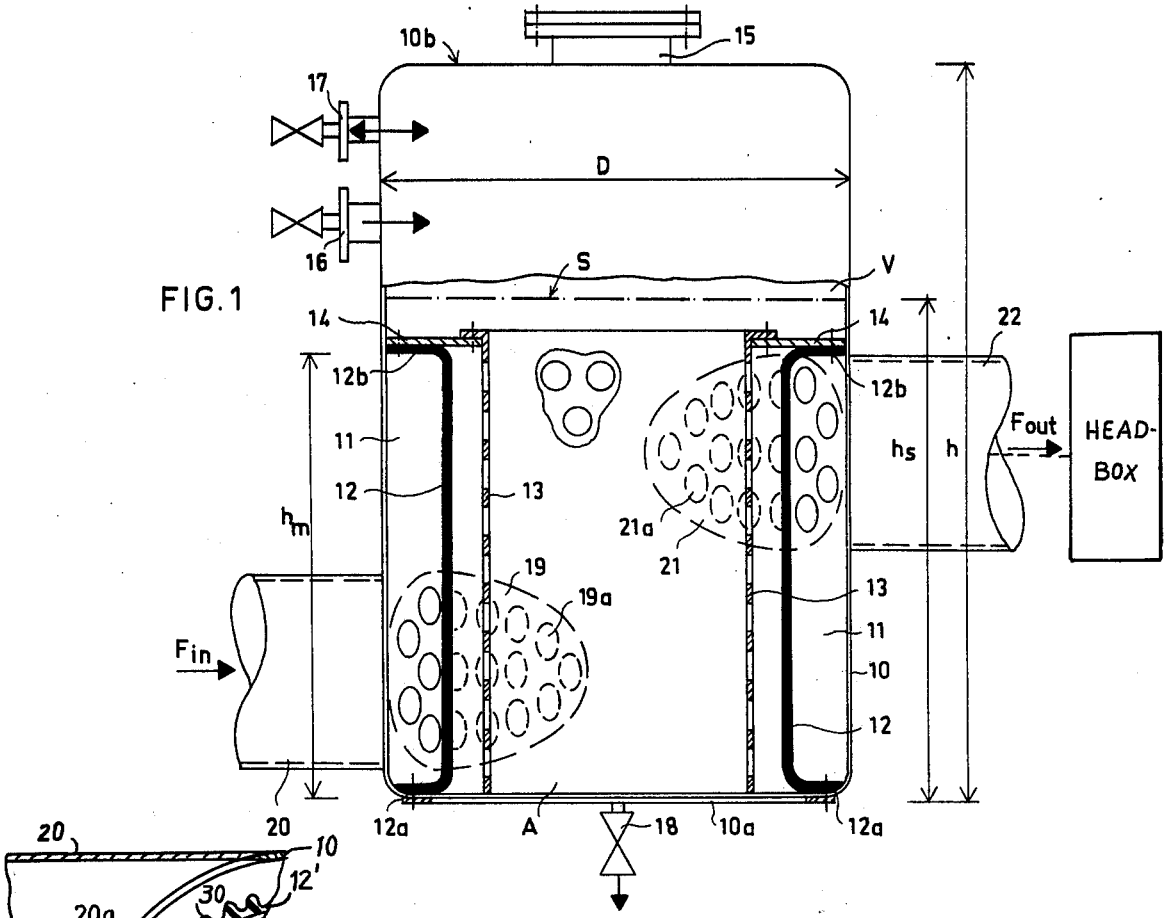
FIG. 1
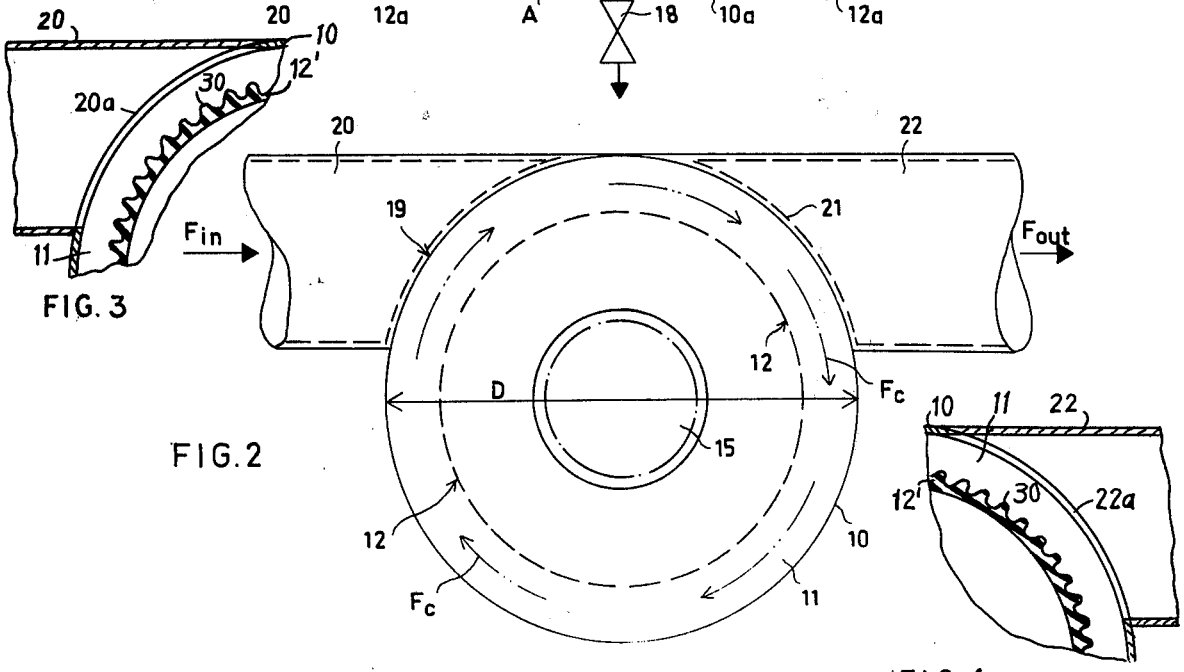
FIG. 3
FIG. 2
FIG. 4

DAMPING STRUCTURE IN A PIPE SYSTEM DELIVERING PULP SUSPENSION TO A HEADBOX

BACKGROUND OF THE INVENTION

The present invention relates to paper machines.

In particular, the present invention relates to structure for damping pressure and flow rate disturbances in pulp suspension flowing toward a headbox.

Thus, the structure of the present invention is intended to be mounted in the pulp pipe system which delivers the pulp suspension to the headbox of the paper machine.

As is well known, disturbances will unavoidably occur in the pulp suspension flowing in an approach pipe system of a paper machine. Thus the pulp stock flows through this approach pipe system toward a headbox such as a hydraulic headbox. With respect to such disturbances, the situation is ideal in the event that each longitudinal element at the lip slice of the headbox continuously discharges precisely the same quantity of suspension per unit of time at a constant velocity. In the event that the rate of flow is the same over the entire breadth of the slice, but varies with respect to time, then there will be a dry weight variation in the machine direction in the paper manufactured thereby.

On the other hand, if the pulp suspension flow is constant with respect to time but varies depending upon the particular location in the cross-machine direction, then a transverse dry weight variation will occur in the paper. This latter type of variation cannot be eliminated by way of the present invention nor by any other damping systems located in the approach pipe system of the stock supply. It is well known that the adjustment of the profile in the cross-machine direction, which is the problem in this particular case, is carried out by way of fine adjustment spindles at the lip slice of the headbox.

Briefly, the output disturbance signals with which the present invention is concerned are in the form of dynamic pressure variations at the lip flow aperture, while input disturbance signals are derived from a number of different sources such as variation in hydrostatic pressure in the pipe system, variation in the output pressure of the pump, variation in the pressure drop of the flowing suspension, pulse pressures due to vibrations transmitted to the pipe system through its supports, and pressure variations caused by turbulence vortices in the pipe system, particularly at the location of valves, pipe bends, etc. It has been found in practice that the different disturbance signals each have their own specific, frequently rather wide frequency spectrum. However, the disturbance signals from pumps, for example, have spectra characterized by distinctly absorbable peaks at the frequencies which are consistent with the speed of rotation of the respective pump and with its multiplesand subharmonics.

In general, paper machine headboxes may be divided into three main groups:

(a) headboxes provided with an air cushion forming a part of the headbox, or so-called air cushion headboxes, (b) hydraulic headboxes provided with an air cushion and mounted separately from the headbox itself, wherein air tanks are located either in the approach pipe system for the paper stock suspension in advance of the distribution header or subsequent to the distribution header, and (c) hydraulic headboxes which do not have any air cushions.

The air cushions are normally used in connection with headboxes in an attempt to equalize pressure variations occurring in the pulp suspension flow prior to the discharge aperture or lip slice of the headbox. These variations may originate in the pulp stock system preceding the headbox or in the headbox itself.

In an air cushion headbox according to type a) referred to above, there is usually an efficient damping of pressure variations with respect to time, inasmuch as the surface area of the pulp stock contacting the air cushion is relatively large while the height of the pulp stock, measured perpendicularly to its direction of flow, is relatively small. A further advantage of such headboxes resides in the fact that the air cushion usually extends up to the vicinity of the discharge slice, so that there is little opportunity for new pressure variations to be generated in the flow between the air cushion and the lip slice.

However, even though the above type of construction has the above favorable features, these air cushion headboxes have in recent times yielded, particularly in the most modern fast paper machines, to hydraulic or fully hydraulic headboxes of the types (b) and (c) referred to above. This development has occurred because the latter two types of headboxes are easier to utilize and situate in connection with the relatively new twinwire formers, and in addition such structures have lower manufacturing costs. The greater turbulence of the pulp stock jet discharging from the lip and its more favorable intensity distribution, as well as the better homogeneity of the stock resulting, are also factors which favor the use of these hydraulic headboxes.

As opposed to these advantages, however, hydraulic headboxes have presented certain difficulties as a result of the pressure variations referred to above. Thus in many instances it has been necessary to provide a headbox initially meant to operate as a fully hydraulic headbox with one or more separate air tanks which tend to be a substitute for the air cushion in an air cushion headbox. Various designs are known with respect to the situation of such separate air tanks. Thus in some designs these air tanks are connected to the pulp stock pipe system in advance of the headbox, while in other designs these air tanks are situated above the headbox itself and connected to the upper part of the headbox by suitable connecting tubes or by a connecting duct.

However, these latter designs have a serious drawback in that an air tank situated above the headbox necessitates a relatively great height for the free liquid level over the central axis of liquid flow, or the communicating tubes or duct from the headbox to the air tank must be dimensioned in such a way that they are relatively narrow as compared with the main flow duct. In either case the damping capability is impaired, as contrasted with the pressure variation damping capacity of a normal air cushion headbox.

SUMMARY OF THE INVENTION

It is accordingly a primary object of the present invention to provide in the approach pipe system which delivers the pulp suspension stock to a headbox, a damping structure which will avoid the above drawbacks.

In particular it is an object of the present invention to provide for damping or pressure and flow rate disturbances while maintaining adequate air volume, a relatively large free surface, a distance from the flow duct to the free surface which is as small as possible, preventing admixture of air and accumulation of air along the flow path, and simplicity as well as reliability and durability of the construction, particularly in connection with start-up and shut-down, and also having the possibility of self-cleaning of the flow duct.

According to the invention there is situated in the approach pipe system which delivers the pulp suspension to the headbox a tank means which has in its interior an upper gas space and a lower liquid space adapted to contain a liquid the upper surface of which contacts the gas in the gas space. Within this tank means there is a diaphragm means which defines with the tank means a flow space for the pulp suspension, this flow space being separated from the liquid space by the flexible diaphragm means. Supply and discharge pipe means respectively deliver and discharge flow suspension to and from the flow space of the tank means, while the gas in the gas space acts through the liquid in the liquid space and the diaphragm means on the flow suspension flowing through the flow space to damp pressure and flow rate disturbances in the pulp suspension flow. Preferably the flow space is of an annular configuration surrounding the liquid space which is filled with a liquid such as water or the equivalent thereof, this liquid communicating at its upper surface with the gas space which may, for example, be filled with air.

BRIEF DESCRIPTION OF DRAWINGS

The invention is illustrated by way of example in the accompanying drawings which form part of this application and in which:

FIG. 1 is a schematic elevation of a damping structure of the invention shown with the lower part of a tank broken away to illustrate in section details of the structure of the invention which are situated within the tank;

FIG. 2 is a top plan view of the structure of FIG. 1;

FIG. 3 is a fragmentary schematic sectional plan view taken at the elevation of a supply pipe and showing a variation of the structure of FIGS. 1 and 2; and FIG. 4 is a fragmentary sectional plan view taken at the elevation of a discharge pipe and also showing a variation of the structure shown in FIGS. 1 and 2.

DESCRIPTION OF PREFERRED EMBODIMENTS

Referring to FIGS. 1 and 2, there is schematically illustrated therein part of an approach pipe system for delivering a pulp suspension to a headbox in the manner schematically indicated. The structure of the invention includes a cylindrical tank means 10 which has an upright central axis and which is of a circular configuration in planes normal to this axis, while having substantially flat upper and lower ends. The upper end **10*b* of the tank means 10 is provided with a manhole 15 which is normally closed by a removable cover, as schematically illustrated. This cover fluid-tightly closes the upper interior portion of the tank means from the outer atmosphere. The lower end 10*a* of the tank means 10 is connected, as schematically illustrated, with a suitable drain pipe 18 which is provided with a valve as illustrated. Thus this drain pipe 18** is normally closed.

The approach pipe system includes a supply pipe means 20 for supplying a pulp suspension to the interior of the tank means 10, as indicated by the arrow $F_{in}$. As is apparent from FIG. 2, the supply pipe means 20 communicates tangentially with the interior of the tank means 10. The approach pipe system also includes a discharge pipe means 22 which also communicates tangentially with the tank means 10 as is apparent from FIG. 2. As is apparent from FIG. 1, the discharge pipe means 22 is situated at an elevation higher than the supply pipe means 20, and the pulp stock suspension flows along the interior of the discharge pipe means 22 so as to continue its travel to the headbox, as indicated by the arrow $F_{out}$. While the pipes 20 and 22 have the different elevations illustrated in FIG. 1, nevertheless these pipes have central axes which at least in the region of the tank means 10 are situated in a common vertical plane which is parallel to the central vertical axis of the cylindrical tank means 10.

The cylindrical wall of the tank means 10 includes a portion 19 which extends across the supply pipe means 20 and which is formed with perforations **19*a*, so that the pulp suspension flows through the foraminous wall portion 19 into the interior of the tank means 10. In a similar manner the wall of the tank means 10 has a portion 21 formed with openings 21*a* through which the pulp suspension discharges into the discharge pipe means 22, so that the pulp suspension also is required to flow through the foraminous wall portion 21 before reaching the discharge pipe means 22**.

Situated in the interior of the tank means 10 is a diaphragm means 12 which is made of a flexible fluid-tight sheet material and which is preferably, though not necessarily, elastic. Thus the diaphragm means 12 may be made of an elastomeric sheet material such as rubber. The diaphragm means 12 has a lower flange **12*a* fixed directly to the outer peripheral portion of the lower wall 10*a* of the tank means 10. Also the diaphragm means 12 has an upper portion 12*b* fixed to a flat ring 14 which is fixedly carried by the wall of the tank means 10 in the interior thereof, this flat circular ring 14 being situated in a plane normal to the central upright axis of the cylindrical tank means 10. Thus it will be seen that the diaphragm means 12 is also of a cylindrical configuration, being coaxial with the tank means 10, and defining with the wall portion thereof which surrounds the diaphragm means 12 a flow space 11 which is of an annular configuration and which is adapted to receive the pulp stock suspension while it flows from the supply pipe means 20 to the discharge pipe means 22. As indicated by the arrows $F_c$ in FIG. 2, the pulp suspension flows in the flow space 11 from the supply pipe means 20 to the discharge pipe means 22** along an ascending helical path.

It is to be noted that it is not essential to utilize foraminous or perforated wall portions 19 and 21 for the tank means at the location of the supply and discharge pipe means. Instead, as shown in FIGS. 3 and 4, the tank means 10 can be formed at its outer wall with simple openings **20*a* and 22*a* through which the pipes 20 and 22 respectively communicate with the flow space 11. However, in this event the diaphragm means 12' is suitably reinforced with a reinforcing means at the locations of the diaphragm means which are in alignment with the openings 20*a* and 22*a*. For this purpose in the illustrated example the diaphragm means 12' is provided with vertically extending ribs 30 which may be integrally formed with the sheet material of the diaphragm means and which are situated at least at the portion of the diaphragm means which is in alignment with the openings 20*a* and 22*a*. Thus, either by way of the perforated wall portions 19 and 21 or by way of the reinforcing ribs 30 of FIGS. 3 and 4 the diaphragm means 12 is prevented from being deflected excessively at the locations where the pulp stock suspension flows respectively into and out of the flow space 11**.

The flexible diaphragm means 12 surrounds an interior liquid space A in the tank means 10, this space A being adapted to be filled with a suitable liquid such as water, and the liquid in the liquid space A extends to an elevation somewhat higher than the diaphragm means. Thus the liquid in the space A is shown in FIG. 1 as having an upper surface S.

Situated within the tank means 10 is an upper gas space V, this gas space being adapted to be filled with a gas such as air maintained at a suitable pressure. Thus, the liquid in the liquid space A operates in such a way that it transmits movement of the diaphragm means 12 to the gas space V which forms the capacitance of the damping system and which of course occupies the space within the tank means 10 which is above the liquid surface S. A tube 17 communicates with the gas space V for introducing a suitable gas such as air under pressure into this gas space, this tube 10 communicating, for example, with an air compressor or with a tank of compressed air. The liquid supplied to the liquid space A is delivered to the interior of the tank through a liquid-supply pipe 16 communicating with any suitable source of liquid. Of course when the structure is not used the liquid can be drained out of the space A through the drain pipe 18.

Within the liquid space A, which is separated from the flow space 11 by the diaphragm means 12, there is a foraminous plate 13 in the form of a cylindrical member formed with openings passing therethrough and situated coaxially in the tank means 10 within the space surrounded by the diaphragm means 12. This perforated cylindrical wall 13 is provided at its top end with a flange which is fixed to the inner peripheral portion of the flat ring 14 so that in this way the position of the perforated, foraminous cylindrical wall 13 is determined within the tank means 10. The purpose of the plate 13 is to protect the diaphragm means 12 against excessive sudden expansion inwardly toward the axis of the tank means, in the event that there is for any reason a sudden drop in pressure in the gas space V. Thus if for any reason pressure should escape from the gas space V, the diaphragm means 12 will be protected by the foraminous wall 13. The outer wall of the tank means 10 which surrounds the diaphragm means 12 serves to protect the latter in the event that there is a pressure surge in the opposite direction. Thus it will be seen that the diaphragm means 12 can be deflected outwardly away from the axis of the tank means 10 only until the diaphragm means 12 engages the inner surface of the wall of the tank means 10.

The height of the liquid in the liquid space A is arranged so as to be relatively small as compared with previously known vertical damping tanks, for example. In this way there is the advantage that the distance from the flow duct to the liquid surface S is minimized. The height $h$ of the tank means 10 is in a range which may as a minimum approximately equal the magnitude of the diameter D of the tank means 10 and which as a maximum will be approximately equal to twice the magnitude of the diameter D of the tank means 10. The height $h_m$ of the diaphragm means 12 is approximately one half of the tank height $h$. The height $h_s$ of the liquid surface S which transmits the pressure between the gas space V and the diaphragm means 12 is preferably only slightly greater than the height $h_m$ of the diaphragm means 12. Thus the height $h_s$ may be on the order of, for example, 5—20% greater than the height $h_m$ of the diaphragm means 12.

As contrasted with known damping structures which include elastic diaphragms, the structure of the invention achieves a particular advantage, among others, that by utilizing an intermediate liquid the diaphragm means of the invention is in its normal state (i.e. in the median position of its oscillatory movement) free of stresses inasmuch as it is not subject to hydrostatic heads of different heights. As a result the elastic force of the diaphragm means does not detract from the capacitance of the damping system and thereby from the damping capacity thereof. Of course, as is pointed out above, the diaphragm means need not be made of an elastic sheet material. In other words the sheet material used for the diaphragm means of the invention need not be stretchable. It can also be made of a flexible sheet material provided with a non-stretchable supporting fabric.

Inasmuch as with the structure of the invention the discharge pipe means is situated at an elevation higher than the supply pipe means, there is a reduction in the possibility of accumulating air in the pulp suspension flow. Furthermore, the structure of the invention is advantageous in that high-quality steel surfaces required are relatively few and small in size.

In addition, there is provided a flow which is free of vortices and which has no dead locations in which the pulp suspension can accumulate without flowing. This latter factor leads to lesser possibility of soiling and clogging the apparatus. With the invention there is also the advantage that the tank means has a relatively small height which, as pointed out above, need only be on the same order as the diameter of the tank, or which at most is only about twice as great as the diameter of the tank, so that in this way the space required by the structure of the invention is relatively small.

Of course, the invention is not to be narrowly confined to the specific examples illustrated in the drawings and described above. The details of the invention may of course vary within the scope of the inventive concept defined by the claims which follow.

What is claimed is:

1. In an approach pipe system for delivering a pulp suspension to a headbox of a paper machine, hollow tank means having means defining in its interior an upper gas space and a lower liquid space adapted to contain a liquid which has an upper surface contacting gas in said gas space, flexible diaphragm means carried by said tank means in the interior thereof and defining with said tank means a flow space separated from said liquid space by said diaphragm means, supply pipe means communicating with said flow space in said tank means for delivering thereto pulp suspension which flows along the interior of said flow space, and discharge pipe means communicating also with said flow space of said tank means for receiving therefrom pulp suspension supplied thereto by said supply pipe means and for continuing the travel of the pulp suspension toward a headbox, whereby gas in said gas space will act through liquid in said liquid space on said diaphragm means for damping pressure and flow rate disturbances in pulp suspension flowing toward the headbox.

2. The combination of claim 1 and wherein said tank means is of a substantially cylindrical configuration while said diaphragm means also is of a substantially cylindrical configuration and is situated in said tank means at the elevation of said lower liquid space thereof.

3. The combination of claim 2 and wherein said diaphragm means is made of an elastic sheet material.

4. The combination of claim 3 and wherein a foraminous wall is situated in said liquid space of said tank means substantially coaxially with said diaphragm means adjacent to but normally spaced therefrom for protecting said diaphragm means.

5. The combination of claim 2 and wherein said tank means has a central upright axis along which said tank means has a given height while said tank means has a given diameter normal to said axis thereof, and said height of said tank means being in a range of from one to two times the magnitude of said diameter.

6. The combination of claim 2 and wherein said tank means has a central upright axis along which said tank means has a given height, and said diaphragm means having a height which is approximately one half the height of said tank means.

7. The combination of claim 2 and wherein said liquid space extends to an elevation which is somewhat higher than said flow space.

8. The combination of claim 2 and wherein said supply and discharge pipe means both communicate tangentially with said flow space of said tank means with said discharge pipe means communicating with said flow space at an elevation higher than the location where said supply pipe means communicates with said flow space.

9. The combination of claim 8 and wherein said supply and discharge pipe means have in the region of said tank means axes which are situated in a common plane.

10. The combination of claim 8 and wherein said tank means has an outer wall portion surrounding said diaphragm means and connected with said supply and discharge pipe means, and said outer wall portion of said tank means being foraminous at parts thereof which are in alignment with said supply and discharge pipe means.

11. The combination of claim 2 and wherein said supply and discharge pipe means as well as said tank means and diaphragm means all cooperate together to provide in said flow space an ascending helical flow path for the suspension travelling from said supply pipe means along the interior of said flow space to said discharge pipe means.

12. The combination of claim 2 and wherein said diaphragm means carries a reinforcement means in alignment with said supply pipe means and discharge pipe means.

13. The combination of claim 12 and wherein said reinforcement means is in the form of ribs which form part of said diaphragm means.

14. The combination of claim 2 and wherein said diaphragm means surrounds said liquid space at an elevation lower than said gas space while said tank means has an outer wall portion connected with said supply and discharge pipe means and defining said flow space with said diaphragm means.

* * * * *